United States Patent [19]

Mowill

[11] Patent Number: 5,070,700

[45] Date of Patent: Dec. 10, 1991

[54] LOW EMISSIONS GAS TURBINE COMBUSTOR

[75] Inventor: Rolf J. Mowill, Rugdeveien 7,0386, Oslo, 3, Norway

[73] Assignee: Rolf Jan Mowill, Oslo, Norway

[21] Appl. No.: 488,136

[22] Filed: Mar. 5, 1990

[51] Int. Cl.[5] ..... F23R 3/20; F02C 7/22

[52] U.S. Cl. ..... 60/738; 60/746

[58] Field of Search ..... 60/39.36, 39.826, 737, 60/738, 733, 746, 748

[56] References Cited

U.S. PATENT DOCUMENTS

| | | | |
|---|---|---|---|
| 2,999,359 | 9/1961 | Murray | 60/737 |
| 3,099,134 | 7/1963 | Calder et al. | 60/752 |
| 4,012,904 | 3/1977 | Nogle | 60/737 |
| 4,073,137 | 2/1978 | Roberts | 60/737 |
| 4,192,139 | 3/1980 | Buchheun | 60/39.826 |
| 4,215,535 | 8/1990 | Lewis . | |
| 4,301,657 | 11/1981 | Penny | 60/759 |
| 4,356,698 | 11/1982 | Chamberlain | 60/737 |
| 4,389,848 | 6/1983 | Markowski et al. | 60/746 |
| 4,928,481 | 5/1990 | Joshi et al. | 60/748 |

*Primary Examiner*—Richard K. Bertsch
*Assistant Examiner*—Timothy S. Thorpe
*Attorney, Agent, or Firm*—Finnegan, Henderson, Farabow, Garrett & Dunner

[57] ABSTRACT

A combustor for a gas turbine engine includes divergent mixing cones disposed within the combustion chamber proper to provide a flow restriction which separates the combustion chamber into primary and secondary combustion zones. Placement of the mixing cones within the chamber enhances vaporization of the fuel and permits combustion to take place in the primary zone at flame temepratures below the stoichiometric temperature thereby reducing formation of nitrous oxides.

21 Claims, 8 Drawing Sheets

LOW EMISSIONS GAS TURBINE COMBUSTOR

BACKGROUND OF THE INVENTION

1. Field of the Invention

The present invention relates to gas turbine engines and, more specifically, to combustors for gas turbine engines.

2. Description of the Related Art

Nitrous oxides, hereinafter $NO_x$, are formed during combustion of fuel with air. Recent investigations and experimentation lead to the concusion that all $NO_x$ formation is "prompt $NO_x$", i.e., $NO_x$ formed during a non-equilibrium combustion process occurring a very short period of time, a few milliseconds, after initiation of the combustion process. It has only recently been postulated that such a non-equilibrium condition creates a severe temperature spike which rapidly decays to the equilibrium temperature, and that substantially all $NO_x$ is formed during these high peak temperatures. This observation has lead to the conclusion that formation of $NO_x$ is independent of residence time within a combustion chamber but is exponentially related to the temperature at which combustion occurs. Such a conclusion is in contradiction to conventional thinking which relates $NO_x$ formation to residence time.

FIG. 1 shows the experimental relationship between $NO_x$ formation and flame temperature. In this figure, the temperature is the equilibrium flame temperature and the amount of $NO_x$ is the sum of all $NO_x$ formed as the temperature drops from its initial high value to the equilibrium value. The amount of $NO_x$ is shown in FIG. 1 as a log value. Hence, while the curve of FIG. 1 is substantially straight, it in fact reflects the exponential relationship to flame temperature.

Because combustion systems using air as the oxygen source always contain mostly nitrogen, and because the relaxation time from the non-equilibrium to equilibrium condition depends solely on the molecules involved in the combustion process, the curve of FIG. 1 is valid for any air-breathing combustion system. Furthermore, the $NO_x$ formation rate at the equilibrium temperature conditions has been shown to be so low that it does not measurably affect the amount of $NO_x$ formed in normal combustion systems where the gas is at the equilibrium temperature for times of a few seconds or less.

Thus, it is an object of the present invention to provide a premixed, convection cooled, low $NO_x$ emission combustor having structural features which take advantage of the conclusion that substantially all $NO_x$ formation is "prompt $NO_x$" related only to the temperature at which combustion occurs and not related to the residence time within the combustion chamber.

It is a further object of the present invention to provide a combustor for a gas turbine engine having improved abilities to vaporize and mix the fuel and air prior to being burned in the combustion chamber.

It is still a further object of the present invention to provide a combustor configuration for a gas turbine engine having a convection cooling air flow passage surrounding the hot wall of the combustor which is substantially free of obstructions to thereby enhance the effectiveness of the cooling air flow through the passages. Such a construction also simplifies the mechanical design of the combustor, reduces manufacturing costs, and simplifies inspection procedures.

It is still a further object of the present invention to provide a combustor configuration which requires fewer fuel injection nozzle than present designs.

It is also an object of the present invention to provide a combustor configuration having a combustion chamber which is separated into primary and secondary combustion zones wherein burning of fuel and air in the primary combustion zone occurs at a reduced flame temperature thereby reducing formation of $NO_x$.

It is still a further object of the present invention to provide a combustor configuration adapted for convection cooling of the combustor wall wherein all the cooling air is used in the combustion process for either combustion with the fuel or for dilution of the products of combustion to reduce the temperature of the gas entering the turbine.

It is still a further object of the present invention to provide a combustor configuration which reduces the amounts of unburned hydrocarbons and carbon monooxide.

SUMMARY OF THE INVENTION

To achieve the foregoing objects, and in accordance with the purposes of the invention as embodied and broadly described herein, a premixed, convection cooled, low emission combustor is provided comprising a combustion chamber for defining a space within which fuel and air are combusted. The combustor further includes means for mixing the fuel and air and for depositing a fuel and air mixture into the combustion chamber. The mixing means, in contrast to known combustor configurations, is disposed within the combustion chamber proper.

In a preferred embodiment, the combustor also includes means for defining primary and secondary combustion zones within a combustion chamber. The defining means may conveniently be comprised of the mixing means which, since disposed within a combustion chamber proper, create a flow restriction which separates the primary combustion zone from the secondary combustion zone. As used herein, separation of the combustion zones is not intended to mean complete isolation of one zone from the other. Rather, separation as used herein means creating a sufficient distinction between the zones that combustion or oxidation of fuel and air in each zone occurs substantially independently with the products of combustion from the primary zone flowing through the secondary zone to exit from the combustion.

A substantially homogenous fuel and air mixture is initially deposited in the primary combustion zone through the mixing means. The fuel-to-air weight ratio of the mixture deposited in the primary combustion zone is closely controlled and is preferably kept below about 50% of the chemically correct stoichiometric ratio of the weight of the fuel to the weight of the air during the entire operating or power range of the engine. Since the flame temperature is directly related to the fuel to air weight ratio, the flame temperature of the fuel and air mixture burned in the primary combustion zone is reduced by keeping the ratio below the stoichiometric ratio. Since the present invention is based on the premise that substantially all $NO_x$ formation is "prompt $NO_x$" and is affected only by the flame temperature during the initial non-equilibrium burn and not by the residence time, the combustor of the present invention limits the formation of $NO_x$ by reducing the flame temperature in the combustion zones.

It is further preferable that the mixing means comprises primary and secondary diverging cones. Each primary and secondary cone is defined by a wall which diverges from an inlet end towards an outlet end. The inlet end is in flow communication with a source of fuel and with the engine air. The divergence angle and the length of the cones defining the mixing means are selected to ensure a complete mixing of the fuel and air prior to being deposited in the combustion chamber and to further ensure that combustion within the cones does not occur. In the case of a liquid fuel, vaporization of the fuel is enhanced as a result of the wall defining the cone being disposed within the combustion chamber and therefore being heated by the flame within the combustion chamber.

When the engine is at idle, fuel is injected into the combustion chamber only through the primary cones, and part of the dilution air is added through the secondary cones. This condition exists for a range of engine power which is determined by the selection of the maximum fuel to air weight ratio for the primary combustion zone. Where the engine is intended to operate over a wider range of power, additional fuel is deposited into a secondary combustion zone through secondary mixing cones. The fuel and air deposited in the secondary combustion zone is oxidized by the products of combustion emerging from the primary combustion zone and the energy of this secondary fuel stream is released even though it might be below the limit of flamability.

It is further preferable that the primary and secondary mixing cones be adapted and disposed within the combustion chamber so as to direct the fuel and air mixture emerging from each in opposite circumferential directions within the respective combustion zone so as to create a counter-swirl condition to enhance mixing when the hot combustion products from the primary zone pass into the secondary zone.

Because the primary and secondary mixing cones are disposed within the combustion chamber proper, and because the fuel and air mixture emerging from those cones is at a lower temperature than the products of combustion, those cones are cooled by the fuel and air mixture. In this configuration, the combustor according to the present invention does not require any special cooling air flow paths to cool the means for defining the primary and secondary combustion zones since the flow restriction created by the cones is already air-cooled by the engine air entering the cones.

The present invention also covers a method of operating a combustor of the type having a combustion chamber separated into primary and secondary combustion zones by mixing cones disposed within the combustion chamber proper. Preferably, the method includes the steps of depositing a primary fuel and air mixture into the primary combustion zone through the mixing cones while maintaining the fuel to air weight ratio below the chemically correct stoichiometric ratio for the fuel. The primary fuel and air mixture is then burned in the primary zone at a temperature to thereby reduce $NO_x$ formation.

Where the engine power requirements, i.e. range, exceeds the energy released in the primary fuel and air mixture, the method of the present invention includes the further step of depositing additional fuel into the secondary combustion zone which will be oxidized by the hot combustion products emerging from the primary zone.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiments given below, serve to explain the principles of the invention. In the drawings.

DESCRIPTION OF THE PREFERRED EMBODIMENT AND METHOD

Figure 1:
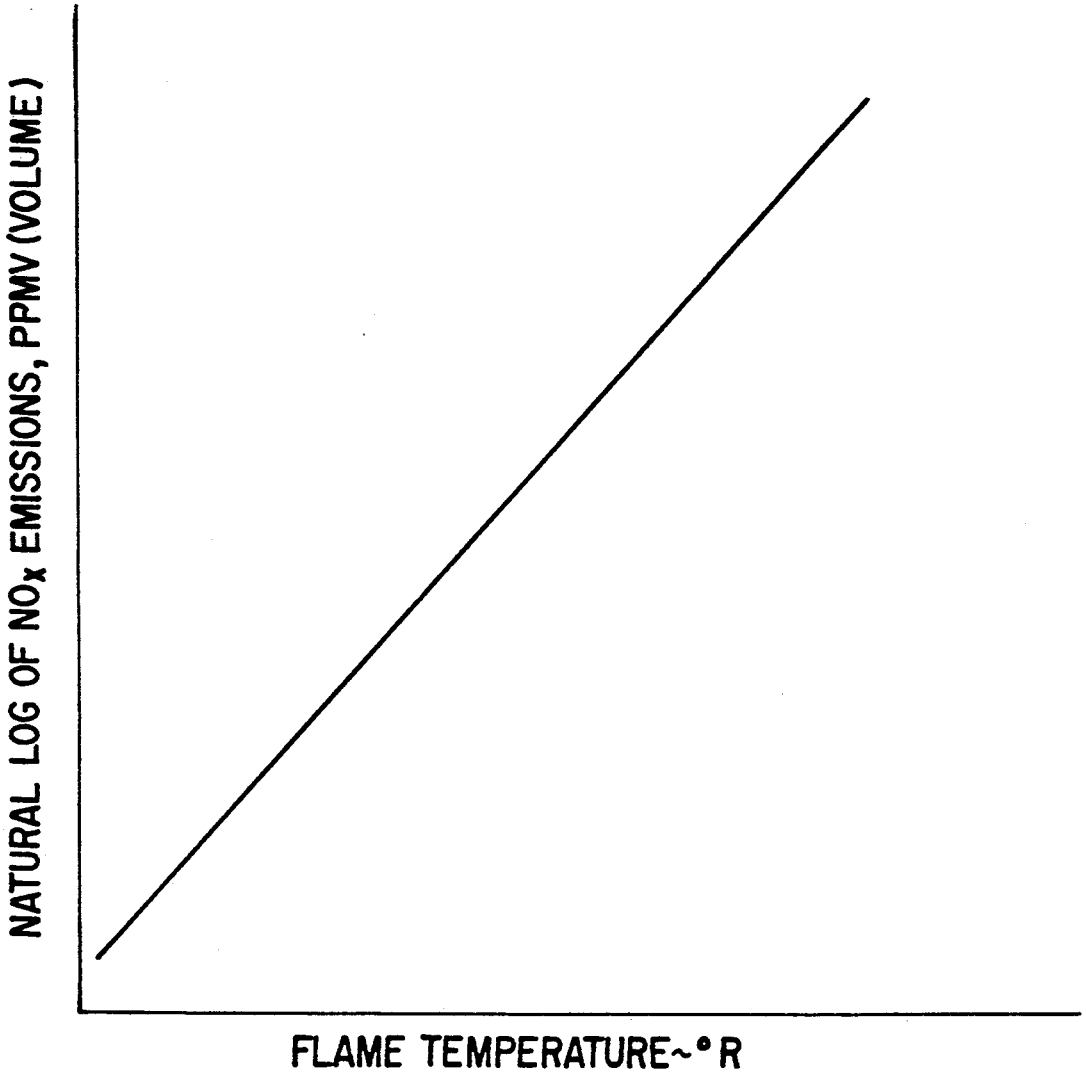
FIG. 1 is a graph illustrating the predicted relationship of flame temperature to the formation of $NO_x$ in a combustion process.

Reference will now be made in detail to the presently preferred embodiments and method of the invention as illustrated in the accompanying drawings, in which like reference characters designate like or corresponding parts throughout the several drawings.

Figure 2:
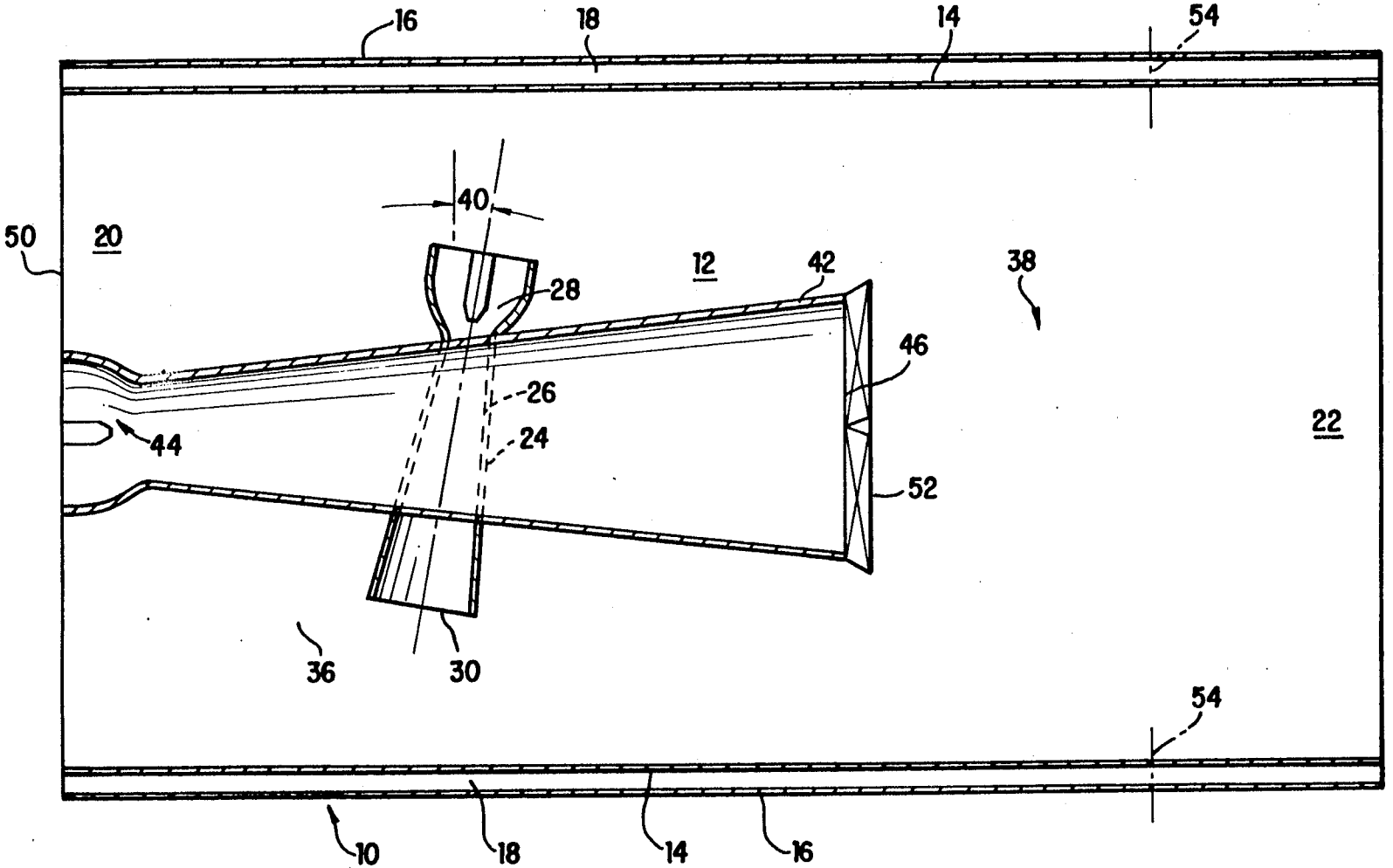
FIG. 2 is a cross-sectional principle view of a can-type combustor incorporating the teachings of the present invention.

FIG. 2 is a principle cross-sectional view of a can-type combustor generally referred to as 10. In accordance with the present invention, can-type combustor 10 includes a combustion chamber 12 having a hot combustor wall 14 which defines the chamber within which fuel and air are combusted. Combustion chamber 12 includes an upstream end 20 and a downstream end 22. Hot combustor wall 14 is surrounded by a cold combustor wall 16 to define a substantially annular cooling air flow passage 18. Engine air, i.e. air flowing through the turbine engine, enters cooling air flow passage 18 and flows along hot combustor wall 14 to thereby provide convection cooling.

The combustor of the present invention is particularly well suited to a convection cooling of the hot combustor wall as opposed to film cooling, although either type of cooling arrangement may be used within the broadest aspects of the invention. Moreover, since the present invention is based on the premise that substantially all $NO_x$ formation is "prompt $NO_x$" and is independent of residence time, the convection cooling arrangement permits all the engine air to be used in the combustion and dilution stages as will be described in more detail below. This, in turn, allows the engine designer to design for a longer residence time in the combustor thereby reducing the amount of unburned hydrocarbons without increasing $NO_x$ formation as has been the conventional wisdom. Film cooling requires that some engine air be dedicated strictly to cooling the combustor wall by placing a thin film of cold air on the interior surface of the combustor wall. This thin film of cold air creates temperature gradients in the combustor wall which promote cracking and ultimate failure. Also, in a film cooling application the cold air entering the combustion chamber effects the fuel-to-air weight ratio and in certain instances quenches combustion in discrete areas of the combustion chamber thereby diminishing efficiency of the combustion process and increasing the amounts of unburned hydrocarbons. The present invention, by being particularly suited to a convection cooling arrangements, eliminates these drawbacks of film cooling.

In accordance with the present invention, the combustor further includes means, disposed within the combustion chamber, for mixing fuel and air and for depositing a fuel and air mixture into the combustion chamber. As embodied herein, the mixing means comprises at least one primary diverging mixing cone 24 disposed within the combustion chamber proper. Any number of diverging cones 24 may be used to fit within the design constraints of a particular engine application. Each cone 24 is defined by a wall 26 which is substantially frusto-conical in shape and which diverges from an inlet end 28 to an outlet end 30.

Figure 3:
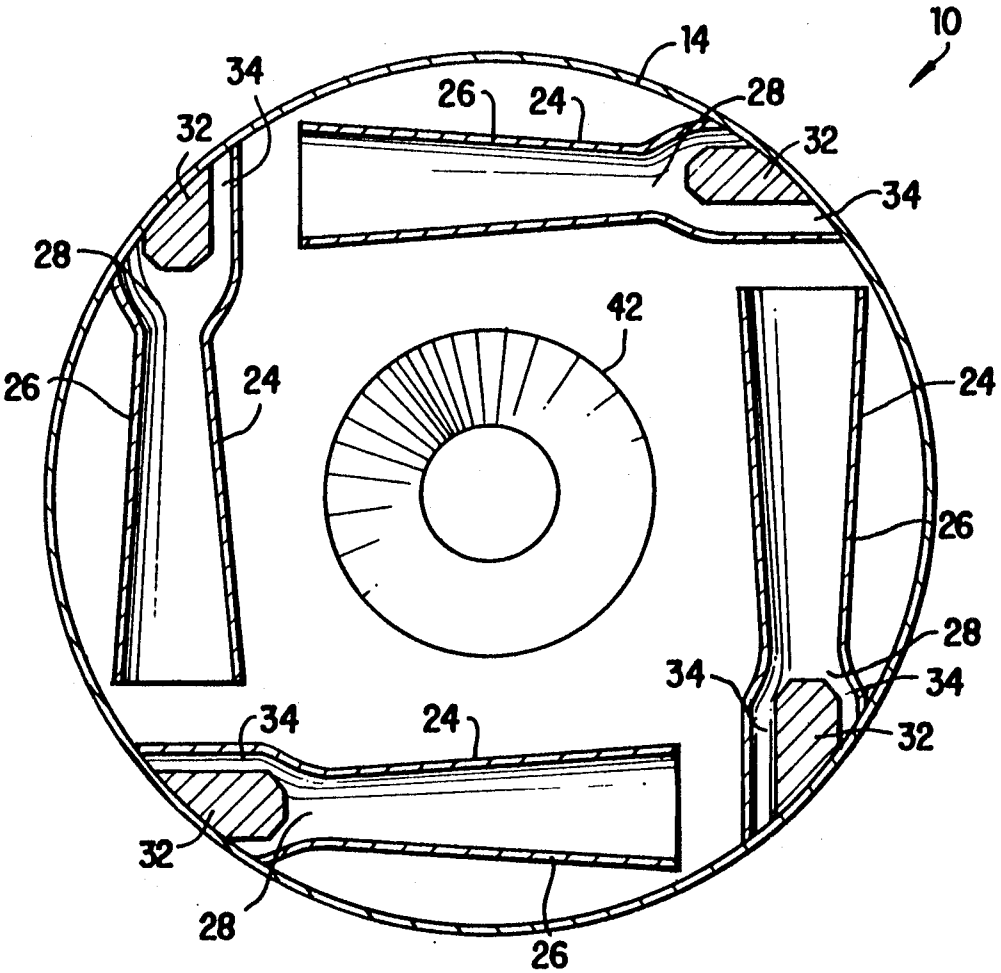
FIG. 3 is an end view of the can-type combustor of FIG. 2.

FIG. 3 is an end view of can-type combustor 10 illustrated in FIG. 2 and shows the primary diverging cones 24 to comprise four cones 24 which extend into combustion chamber 12 from hot combustor wall 14 at an angle approaching a tangent line from wall 14 at about the position of the injectors 32. Inlet end 28 of cone 24 is in flow communication with the source of fuel (not shown) which is injected into cone 24 through fuel injectors 32. Similarly, the inlet end 28 of each cone 24 communicates with the high pressure engine air exiting the compressor section (not shown) via a conduit 34 formed around fuel injector 32.

As fuel and air are injected into cones 24 via injectors 32 and conduit 34, they become homogenously mixed within the cone prior to being deposited within the combustion chamber 12. The change in velocity of the air as it expands in cone 24 tends to shear the surface of the fuel droplets thereby enhancing vaporization and mixing. Also, cones 24 are sized such that the velocity of the air as it expands in the cone is kept greater than the flame speed in the combustion chamber so that the flame does not enter the cone causing premature combustion.

A particular advantage of the present invention over prior art combustors is the placement of the mixing means comprised of cones 24 within the combustion chamber proper. In this manner, the cone walls 26 are heated by the flame temperature within combustion chamber 12 to enhance vaporization of liquid fuel.

The divergence angle of the cone wall 26 relative to the central axis of the cone is preferably selected to be the highest angle possible while still avoiding separation of the flow from the wall. Typically, aerodynamic constraints limit the divergence angle of cone wall 26 to a 7° half angle thus making a 14° included angle. Smaller angles may be used but will likely require an increased length of the cone.

Furthermore, in the preferred embodiment of the present invention, fuel injectors 32 are preferably mounted just upstream of the small diameter inlet ends of diverging cones 24. Fuel injector 32 may be made movable relative to inlet end 28 of cone 24 so as to calibrate the air flow entering the cone. In this manner, it is possible to balance the air flow through each cone 24 such that the same flow rate of air is always entering each cone. Thus, the fuel to air weight ratio in cones 24 is dependent only upon the fuel pressure, and hence fuel flow, at injectors 32.

To provide low $NO_x$ emission from the combustor, the present invention includes means for defining primary and secondary combustion zones within combustion chamber 12. As embodied herein, the defining means is comprised of the primary cones 24 disposed circumferentially around hot combustor wall 14 and when applicable, the secondary cone 42 to create a flow restriction by narrowing the effective cross-sectional area of the combustion chamber at the position where the cones are placed. In this manner, the combustion chamber is separated into axially aligned primary and secondary combustion zones 36 and 38, respectively.

In the combustor of the present invention, the primary fuel and air mixture deposited in combustion chamber 12 through primary cones 24 is directed toward primary combustion zone 36 by tilting cones 24 toward upstream end 20 of combustion chamber 12. The angle of tilt 40 of cones 24 may be between about 5° and 15°, and is preferably set at about 10°. However, the specific angle of tilt is not limitive of the scope of the present invention. Furthermore, the fuel-to-air weight ratio of the mixture emerging from primary cones 24 is preferably limited to less than about 50% of the chemically correct stoichiometric ratio while still being above the lowest fuel-to-air weight ratio which will support combustion. Of course, the fuel to air ratio in primary cones 24 will vary between the upper and lower limits as the engine is throttled and the fuel flow is adjusted accordingly by valve arrangements well known in the art.

By limiting the fuel-to-air weight ratio in primary cones 24 to below 50% of the stoichiometric value, the flame temperature in primary combustion zone 36 is reduced thereby reducing the amount of $NO_x$ formed during combustion.

Thus, by tilting diverging cones 24 toward upstream end 20 of combustion chamber 12, the primary fuel and air mixture emerging from cones 24 is directed toward primary combustion zone 36 where it may be ignited by conventional means to start the combustion. Furthermore, by disposing cones 24 circumferentially about hot combustor wall 14 at an angle approaching a tangent as illustrated in FIG. 2, the primary fuel and air mixture is directed into a swirling pattern in primary combustion zone 36. In that regard, a specific advantage of the configuration of the combustor of the present invention is that all of the fuel vaporization and mixing takes place within primary cones 24 and no space need be provided in the combustion zone for these two functions. Typically, a residence time of 3 to 10 milliseconds is adequate for the fuel and air mixture to be completely combusted within primary combustion zone 36.

Since the fuel-to-air weight ratio in primary combustion zone 36 is maintained well below the stoichiometric value, the flame temperature in primary combustion zone 36 is reduced. Because formation of $NO_x$ is assumed to be dependent on the flame temperature and not on the residence time in the combustor, the fuel and air mixture is burned in the primary combustion zone 36 with significantly reduced $NO_x$ formation. Furthermore, in contrast to conventional thinking, the residence time of the products of combustion in the combustion chamber may be increased to reduce the amounts of unburned hydrocarbon and CO without penalty of increased $NO_x$ emissions. Typically, such residence time may be increased by lengthening the combustion chamber, or moving dilution holes further downstream.

In gas turbine engines that operate over a wide range of power, it is necessary that the mixing means include at least one secondary cone 42, having an upstream inlet end 44 and a downstream outlet end 46, for depositing additional fuel into the secondary combustion zone 38 of combustion chamber 12. A fuel injector 32 is disposed proximate inlet end 44 and engine air is introduced into secondary cone 42 through appropriate conduit paths. In the preferred embodiment of the can-type combustor of the present invention, secondary cone 42 extends into combustor 10 from an end wall 50 such that downstream end 46 is centrally disposed within combustion chamber 12 to deposit a secondary fuel and air mixture into secondary combustion zone 38. With such a configuration, secondary cone 42 acts in cooperation with primary cones 24 to provide a flow restriction within combustion chamber 12 to separate the combustion chamber into the upstream primary combustion zone 36 and the downstream secondary combustion zone 38.

In combustors which require the secondary cone and secondary fuel and air mixture, engine air in the preferred embodiment is always introduced into the combustion chamber through the secondary cone for dilution purposes even when additional fuel is not required at the low end of the power range. When engine power is increased by advancing the throttle, fuel flow through injectors 32 of primary cones 24 is initially increased while remaining within the predetermined fuel to air weight ratio selected for the primary combustion zone. This is shown graphically in FIG. 7 which plots the fuel to air ratio in the primary and secondary fuel and air streams as a function of engine power in a typical engine application.

Figure 7:
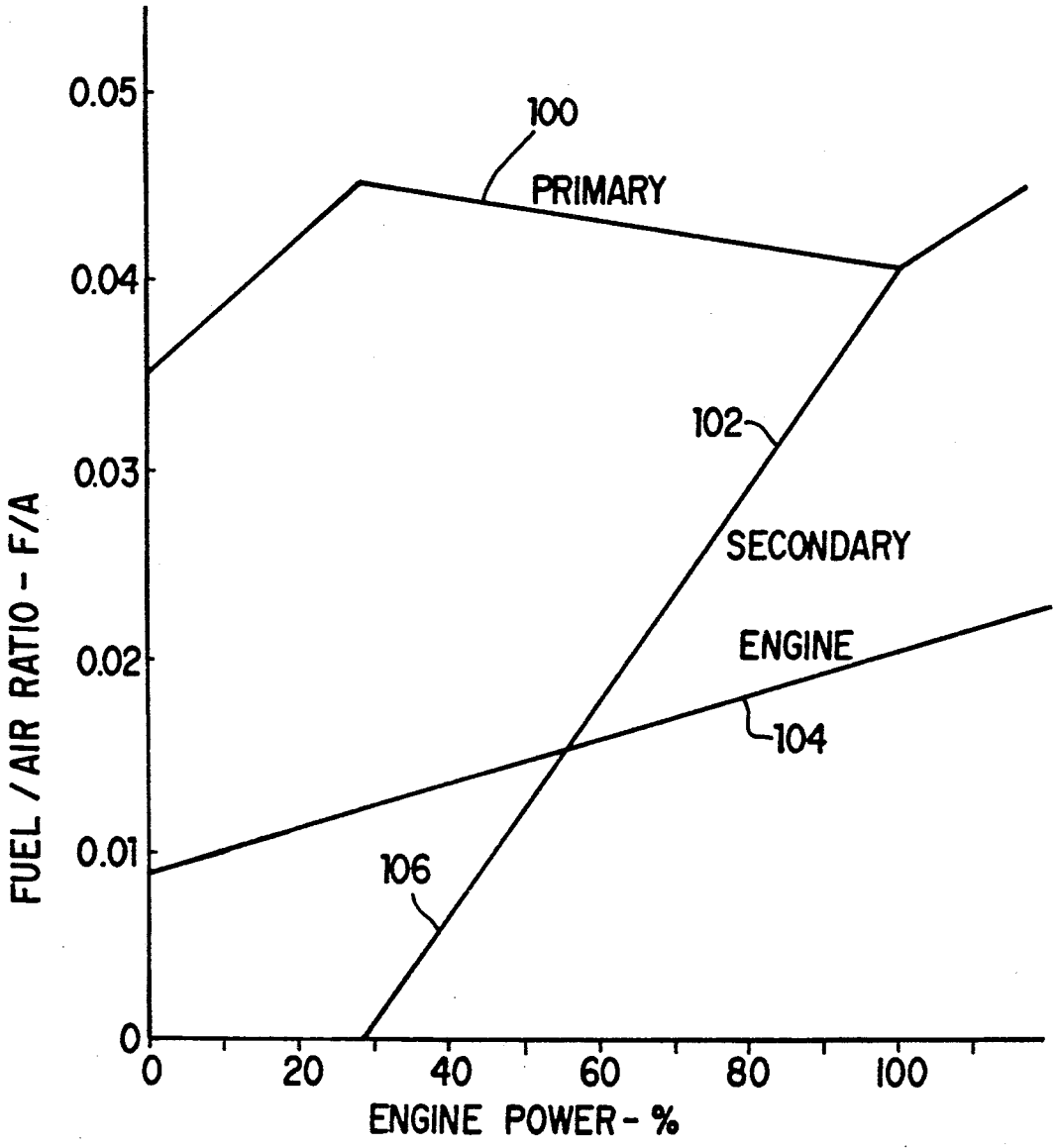
FIG. 7 is a graph illustrating how the fuel to air weight ratio in the primary and secondary fuel and air mixtures typically varies over the operating range of the engine.

Graph line 100 in FIG. 7 is the plot of the fuel to air weight ratio in the primary stream over the engine power range, and graph line 102 is the fuel to air ratio in the secondary stream. The overall engine fuel to air ratio is shown by line 104. As illustrated, when reaching a predetermined operating point 106, fuel is injected into and mixed with the air in secondary cone 42. As engine power is increased, the fuel to air ratio in the secondary stream continues to increase while the ratio of the primary stream tails off slightly. The graph of FIG. 7 is presented by way of example only. The particular trends shown are not limitive of the scope of the present invention since they may change for particular applications.

The additional fuel and air is initially supplied to cone 42 preferably at a weight ratio of fuel to air too low to support combustion. However, when this secondary mixture from cone 42 mixes with the hot products of combustion coming from primary combustion zone 36, the fuel in the secondary mixture is oxidized completely within second combustion zone 38.

Furthermore, to enhance mixing of the fuel and air emerging from cone 42 with the hot products of combustion coming from primary combustion zone 36, the preferred embodiment of the present invention incorporates a swirler 52 attached at the downstream end 46 of cone 42. Any known configuration of swirler may be utilized. For instance, a swirler comprised of a plurality of vanes equally spaced around the circumference of the downstream end of cone 42 and tilted at an angle to impart a swirling motion to the fuel and air mixture emerging from the cone may be used.

Also, the swirl direction important to the secondary mixture emerging from cone 42 is preferably selected to be counter to the direction of swirl of the combustion occurring in primary combustion zone 36. Such counter-swirl of the fuel and air mixtures in the primary and secondary combustion zones, and the ensuing counter-swirl of the combustion products since ignition of the fuel in fact occurs a very short distance from the outlet ends of the cones, enhances mixing in the secondary combustion zone.

Furthermore, because primary cones 24 and secondary cones 42 are disposed within combustion chamber 12, the configuration of the present invention has the advantages of simplifying the mechanical design of the combustor, reducing manufacturing cost, and making assembly and inspection procedures more efficient. Also, because the mixing cones of the present invention do not extend through the combustor wall, cooling air flow passage 18 is substantially free of obstructions thereby making the combustor wall particularly well suited to a convection cooling as opposed to film cooling. Thus, the disadvantages of film cooling, i.e. the need to use engine air strictly for cooling purposes, the temperature gradients in the combustor wall created by film cooling, and the lower efficiency of combustion, are eliminated.

With continued reference to FIG. 2, dilution holes 54 may be configured in hot combustor wall 14 downstream of second combustion zone 38. These dilution holes 54 function to introduce the remaining air which has not passed through the mixing means into the combustion chamber to thereby drop the outlet temperature of the products of combustion emerging from combustion chamber 12 to a level suitable for a turbine or other end device (not shown). Thus, combustor 12 utilizes all the engine air in either the combustion or dilution processes.

Figure 4:
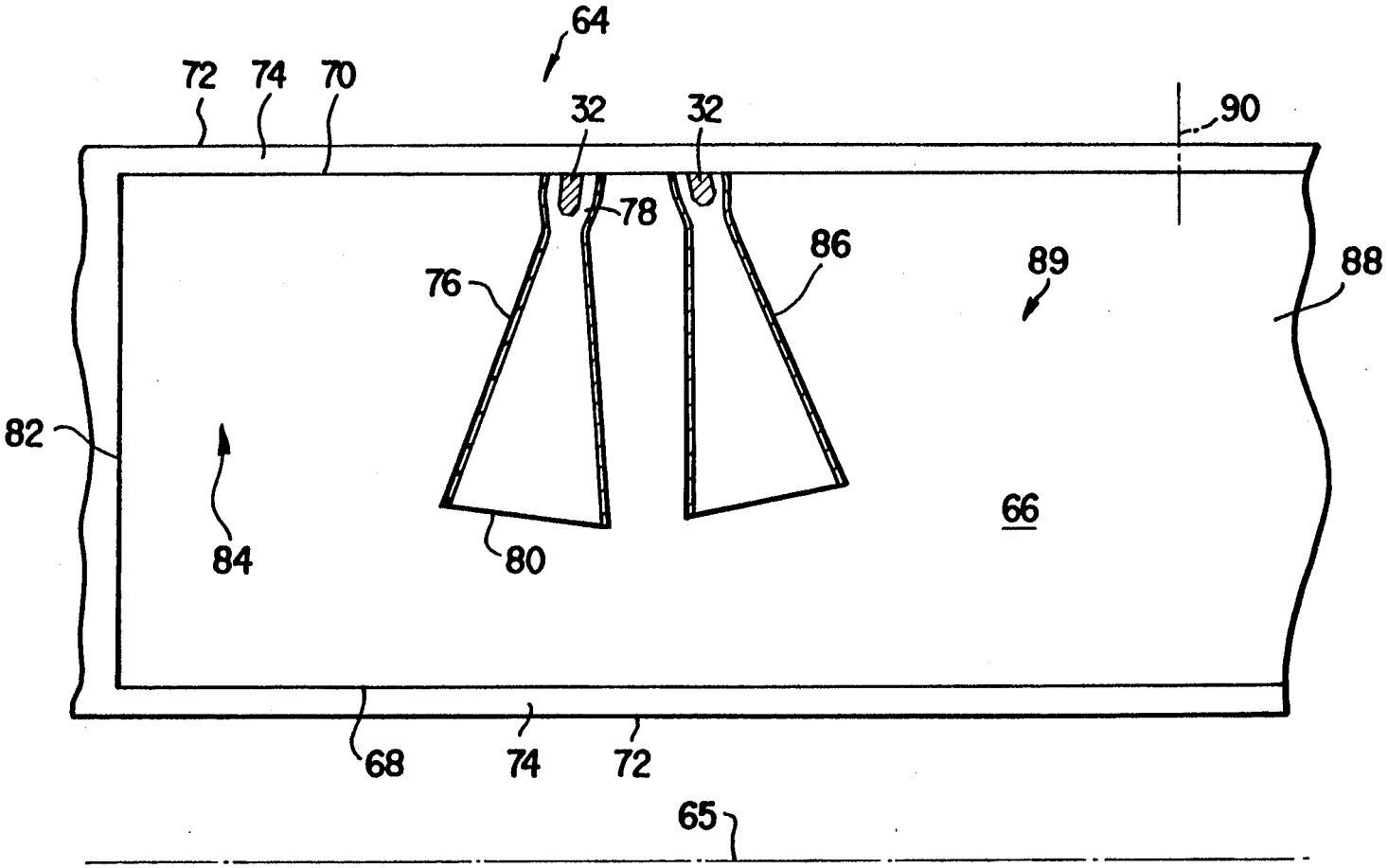
FIG. 4 is a cross-sectional principle view of an annular combustor incorporating the teaching of the present invention.

In a second embodiment of the present invention shown in principle view in FIG. 4, an annular combustor is generally referred to as 64. Combustor 64 is comprised of a combustion chamber 66 which is defined by inner and outer hot combustor walls 68 and 70, respectively. Combustor walls 68 and 70 are radially spaced from one another relative to the center line 65 of the combustor. Running substantially parallel to and spaced from each inner and outer hot combustor wall 68 and 70 are respective cold combustor walls 72 which define cooling air flow passages 74 through which engine air is directed to provide convection cooling for the hot combustor walls.

The embodiment of the present invention illustrated in FIG. 4 includes mixing means similar to the mixing means previously described with reference to FIGS. 2 and 3 but having a placement adapted for the annular combustor geometry. Specifically, the mixing means of the annular combustor illustrated in FIG. 4 includes primary diverging mixing cones 76 for defining a space wherein the fuel and air is mixed. Primary mixing cones 76 are substantially identical in configuration to the cones 24 illustrated in FIGS. 2 and 3.

Figure 5:
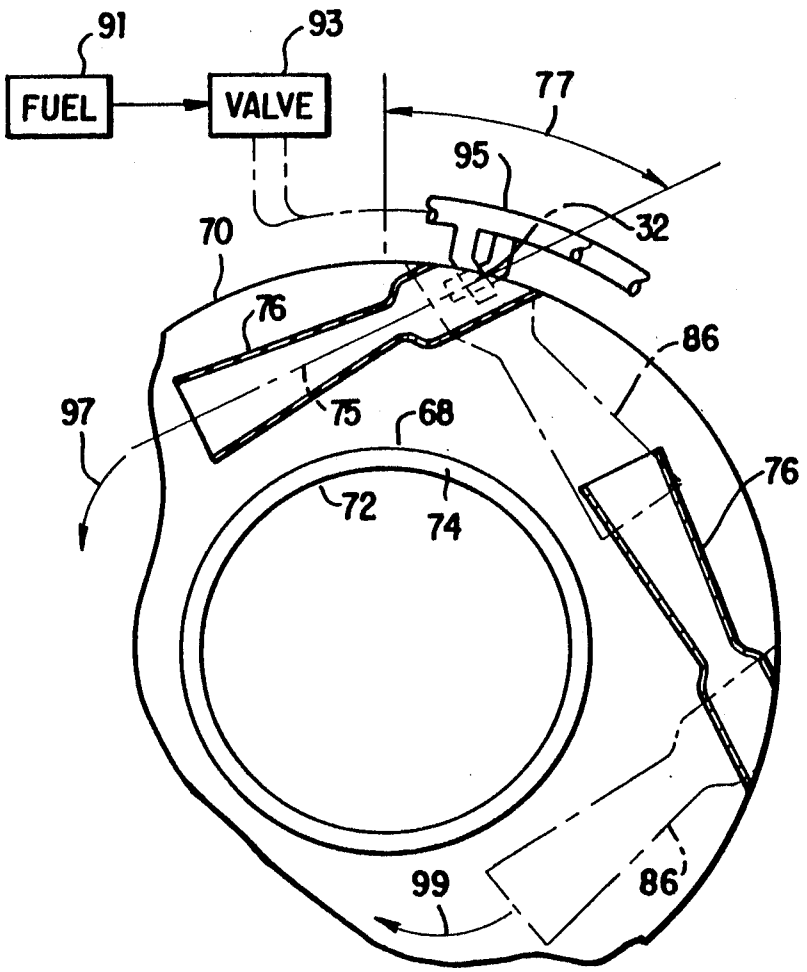
FIG. 5 is a partial end view of the annular combustor of FIG. 4.

With reference to FIG. 5 which shows a partial end view of combustor 64, primary cones 76 extend inwardly into combustion chamber 66 from outer hot combustor wall 70 and the central axis 75 of cones 76 is disposed at an angle 77 relative to a radius extending from center line 65 in a similar manner as illustrated for cones 24 shown in FIG. 3. Any desired number of primary cones sufficient to promote and enhance complete combustion within the combustion chamber 66 may be used.

Each primary cone 76 includes an inlet end 78 and an outlet end 80 with inlet end 78 being in flow communication with a source of fuel 91 via a valve arrangement 93, fuel manifolds 95, and ultimately a fuel injector 32 disposed at inlet end 78. Engine air is supplied to the inlet ends of primary cones 76 in substantially the same manner as previously described for cones 24. Furthermore, primary cone 76 is tilted toward an upstream end 82 of combustion chamber 66 so as to initially direct and deposit the fuel and air mixture emerging from cone 76 in a primary combustion zone 84 which is proximate upstream end 82 of the combustion chamber.

The fuel-to-air weight ratio of the mixture emerging from primary cones 76 is kept below the chemically correct stoichiometric ratio so as to reduce the flame temperature in primary combustion zone 84 thereby reducing $NO_x$ formation. Of course, the fuel-to-air weight ratio in primary cones 76 varies between the lean blowout lower limit and the preset upper limit as the power output of the engine is increased. In the preferred embodiment of the present invention, the upper limit of the fuel-to-air weight ratio in primary cones 76 is set at about 50% of the stoichiometric value. However, a higher ratio may be selected within the scope of the invention so long as the corresponding flame temperature is kept low enough to reduce $NO_x$ formation in the primary combustion zone.

Also, since $NO_x$ is formed only during the high temperature, non-equilibrium condition immediately after ignition of the fuel in primary combustion zone 84, and residence time is not a factor significantly influencing $NO_x$ formation, the combustor of the present invention may be designed such that the combustion products have a residence time greater than has previously been thought permissible. With such an increased residence time unburned hydrocarbons are significantly reduced thereby reducing pollutant emissions such as CO from the engine.

A further advantage of the configuration of the embodiment of the present invention illustrated in FIG. 4 is the ability to utilize fewer fuel injection nozzles than known annular combustor configurations. This advantage results from the enhanced vaporization occurring within the cone 76, and as a further result of the position of cones 76 relative to outer hot combustor walls 70. That is, since cones 76 are disposed substantially tangentially relative to outer hot combustor wall 70, the fuel and air mixture emerging from cone 76 is directed into an annular flow path around primary combustion zone 84 as shown by arrow 97 in FIG. 5. The directed flow in the peripheral direction about primary combustion zone 84 results in improved flame holding and reduces the number of injectors required. Obviously, reducing the number of injection nozzles eliminates potential problems with regard to clogging of those nozzles and subsequent discontinuities in the burn pattern within the combustion chamber and reduces cost of hardware.

In instances where the operating range of the engine requires additional fuel flow range over and above that provided through primary cones 76, annular combustor 64 may also be configured with secondary diverging mixing cones 86 which are tilted toward the downstream end 88 of combustion chamber 66 so as to direct the fuel and air mixture exiting from the secondary cones toward a secondary combustion zone 89 disposed proximate downstream end 88 of combustion chamber 66. Such secondary cones would be required where the operating range of the engine cannot be fully met with the fuel flow through primary cones 76. In those instances, additional fuel may be injected into secondary combustion zone 89 in the same manner as described above with reference to FIG. 7.

With reference to FIG. 5, secondary cones 86 extend from hot combustor wall 70 at an angle which is opposite to angle 77 but preferably of the same magnitude. In this manner, secondary cones 86 direct the secondary fuel and air mixture in a direction 99 around annular combustion chamber 66 which is opposite to the direction 97 in which the flow from primary cones 76 is directed. Thus, when the combustion products from the primary combustion zone enter the secondary combustion zone a counter swirl condition is created in the secondary zone to enhance mixing and oxidation combustion of the secondary fuel and air stream.

In the annular combustor 64, just as with the can-type combustor previously described, the means for defining primary and secondary combustion zones within the combustion chamber means comprises a flow restriction created by the walls of the cones 76 and 86. Furthermore, dilution holes 90 are configured in the inner and outer hot combustor walls so as to add dilution air from cooling air flow passage 74 into the combustion chamber upstream of secondary combustion zone 89. The dilution air acts to reduce the temperature of the products of combustion to a level which is acceptable for use in a turbine or other end device.

Figure 6:
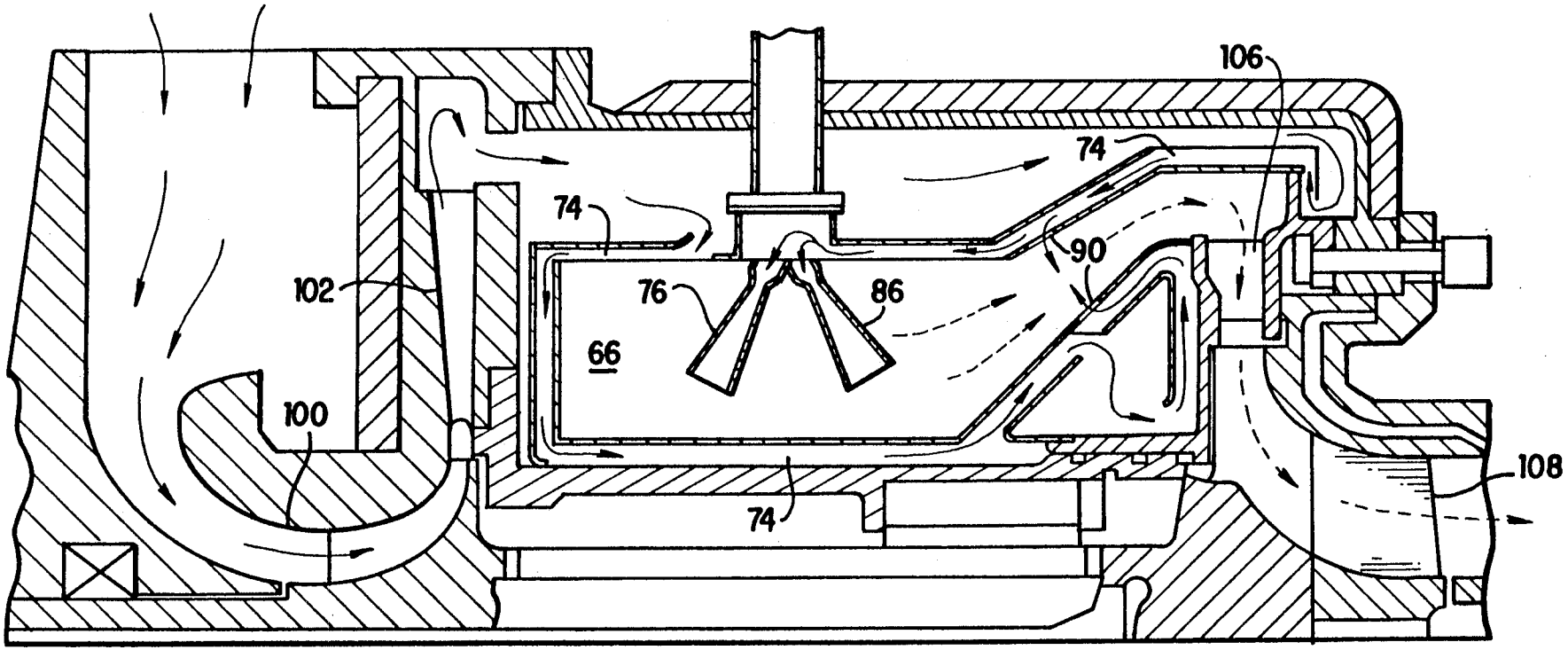
FIG. 6 is a cross-sectional view of the annular combustor of FIG. 4 installed in a radial gas turbine engine module.

FIG. 6 is a cross-sectional view of a radial turbine engine module having the annular combustor of the present invention disposed therein. In FIG. 5, a compressor 100 feeds engine air to a diffuser 102. From diffuser 102, the engine air enters cooling air flow passage 74, primary and secondary cones 76 and 86, and dilution holes 90 as shown by the arrowed lines. Fuel and air enters the combustion chamber 66 through mixing cones 76 and 86 as previously described. The remaining engine air is injected through dilution holes 90 to reduce the temperature of the products of combustion prior to entering a turbine inlet nozzle 106 and expanding through a turbine 108 to provide useful work.

The present invention also encompasses a method for operating a gas turbine engine combustor of the type having sequentially aligned primary and secondary combustion zones separated and defined by at least one primary mixing cone disposed within the combustion chamber to create a flow restriction therein. The steps of the method of the present invention are illustrated in the block diagram of FIG. 8. At step 150, primary fuel and primary air are mixed in the primary mixing cone at a fuel-to-air ratio less than the stoichiometric ratio of the fuel employed. At step 152 the primary fuel and air mixture is deposited into the primary combustion zone where it is ignited. Preferably, the fuel-to-air weight ratio in the mixing cone is carefully controlled and limited to less than about 50% of the stoichiometric ratio of the fuel employed. In this manner, when the primary fuel and air mixture is burned in the primary combustion zone the flame temperature is reduced thereby reducing formation of $NO_x$ in the primary zone.

Figure 8:
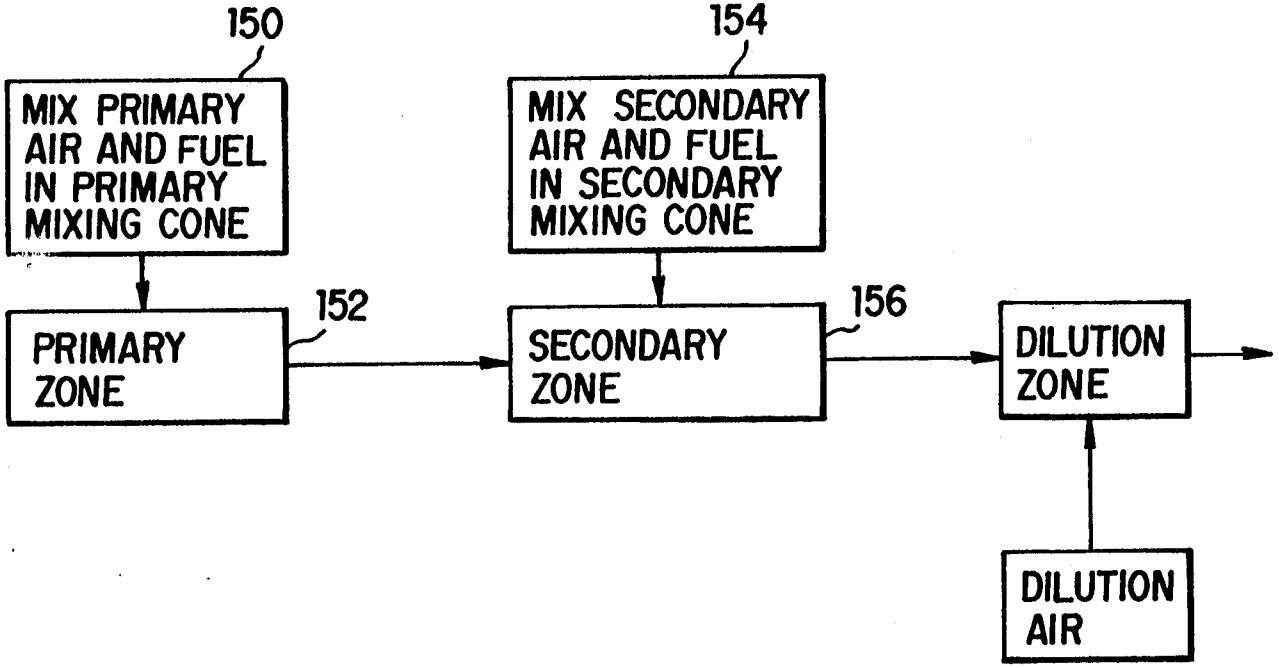
FIG. 8 is a block diagram illustrating the steps of the method of the present invention.

In instances where the operating range of the engine employing the combustor of the present invention requires additional fuel flow beyond that in the primary mixture, the method of the present invention encompasses the additional step of mixing secondary fuel and secondary air in a secondary mixing cone disposed in the combustion chamber as shown in block 154 of FIG. 8. Thereafter, the secondary fuel and air mixture from the second mixing cone is deposited in the secondary combustion zone at block 156 where it is oxidized/-burned by mixing with the hot products of combustion emerging from the primary combustion zone. As the engine power requirements increase, the fuel-to-air weight ratio in the secondary mixing cones may be increased as illustrated on the graph of FIG. 7.

Finally, the method of the present invention encompasses the step of adding dilution air into the combustion chamber in a dilution zone disposed downstream from the secondary combustion zone. As previously described, the dilution air acts to lower the temperature of the hot products of combustion such that air suitable for use in an end device connected to the gas turbine engine.

By practicing the steps of the method of the present invention, the flame temperature within the primary combustion zone may be reduced to thereby reduce the formation of $NO_x$. Furthermore, as illustrated in FIG. 7, since the fuel-to-air weight ratio in the secondary fuel and air mixture is also maintained below the stoichiometric fuel-to-air ratio $NO_x$ formation is also significantly reduced when the fuel is combusted in the secondary combustion zone. Moreover, since $NO_x$ formation is independent of residence time within a combustor, the method of the present invention may also include maintaining the residence time of the fuel and air in a combustion chamber for a period of time sufficient to substantially reduce the amount of hydrocarbons and carbon monoxide. Thus, the method and apparatus of the present invention provide a combustor for a gas turbine engine wherein $NO_x$, UBH and CO emissions are substantially reduced over prior art combustor configurations.

Additional advantages and modifications will readily occur to those skilled in the art. For instance, the flow restriction which separates the primary and secondary combustion zones may be comprised of a narrowing of the hot combustor walls at the position where the flow restriction is to be placed. Alternatively, a combination of narrowed hot combustor walls and diverging cones may be used to provide the flow restriction. Also, more than two combustion zones may be defined within the combustion chamber to further stage the burn of the fuel, and thereby further reduce emissions. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A gas turbine engine combustor, comprising:

a combustion chamber for defining a combustion zone within which fuel and air are combusted, said combustion chamber being defined by a combustor hot wall and having an upstream end and a downstream end;

means for mixing unignited primary fuel and air and for depositing an unignited primary fuel and air mixture into said combustion chamber, said mixing means including at least one primary diverging cone disposed proximate said upstream end of said combustion chamber and substantially within said combustion chamber and having a narrow inlet end through which fuel and air enter said cone and a wide outlet end through which the fuel and air mixture exits into the combustion chamber, said primary diverging cone extending into said combustion chamber from said combustor hot wall and substantially tangentially relative to said combustor hot wall such that the primary fuel and air mixture exits the primary diverging cone in a swirling direction about said combustion zone;

means for injecting fuel into the inlet end of said mixing means;

means for injecting air into the inlet end of said mixing means; and said mixing means being configured such that substantially all of the fuel and air for combustion injected into the inlet end of said mixing means passes through the outlet end of said mixing means into said combustion chamber.

2. The combustor of claim 1, including means for defining at least primary and secondary combustion zones within said combustion chamber.

3. The combustor of claim 2, wherein said defining means is comprised by said at least one primary cone which creates a flow restriction in the combustion chamber to separate said primary combustion zone from said secondary combustion zone.

4. The combustor of claim 3, wherein said mixing means also includes at least one secondary diverging cone for depositing a secondary fuel and air mixture into said secondary combustion zone, said at least one secondary cone diverging outwardly from a narrow inlet end toward a wide outlet end.

5. The combustor of claim 4 wherein said at least one secondary cone, in cooperation with said at least one primary cone, comprises said defining means by creating a flow restriction in the combustion chamber which separates said primary combustion zone from said secondary combustion zone.

6. The combustor of claim 1, wherein said combustion chamber comprises a can-type combustion chamber having an upstream end, a downstream end, and a combustor hot wall, said primary combustion zone being proximate said upstream end and said secondary combustion zone being proximate said downstream end; and said at least one primary cone being tilted toward said upstream end of the combustion chamber such that the fuel and air mixture emerging from said primary cone is initially directed into the primary combustion zone.

7. The combustor of claim 6, wherein the angle of tilt of said primary cone is between about 5° and 15°.

8. The combustor of claim 6, including at least one secondary diverging cone for depositing a secondary fuel and air mixture into said secondary combustion zone, said secondary cone having an inlet end and an outlet end, said secondary cone being substantially aligned with the central axis of the combustion chamber such that said inlet end originates at an upstream end wall of said combustion chamber and said outlet end terminates in said secondary combustion zone.

9. The combustor of claim 8, wherein said secondary cone includes means for imparting a swirling flow to the secondary fuel and air mixture emerging therefrom, said swirl means being configured to direct the secondary swirl in a direction opposite to the direction of swirl in said primary combustion zone.

10. The combustor of claim 2, wherein said combustion chamber comprises an annular combustion chamber having an upstream end, proximate said primary combustion zone, a downstream end, proximate said secondary combustion zone, and inner and outer combustor hot walls radially spaced from one another to define said annular combustion chamber;

said mixing means comprising a plurality of said primary cones extending into the combustion chamber substantially tangentially relative to said outer hot combustor wall so as to impart a swirling flow to the primary fuel and air mixture emerging from the primary cones around said primary combustion zone, and said primary cones being tilted toward said upstream end of the combustion chamber such that the primary fuel and air mixture is directed toward said primary combustion zone; and said mixing means further including a plurality of secondary cones extending into the combustion chamber substantially tangentially relative to said outer hot combustor wall and being tilted toward said downstream end of said combustion chamber such that a secondary fuel and air mixture exiting from said secondary cones is directed toward said secondary combustion zone, said secondary cones being disposed to impart a swirling flow to the secondary fuel and air mixture with the direction of swirl in said secondary combustion zone being opposite to the direction of swirl in the primary combustion zone.

11. The combustor of claim 2, including means for adding dilution air to the combusted fuel and air upstream of said secondary combustion zone.

12. The combustor of claim 11, wherein said combustion chamber means includes an inner hot wall and an outer cold wall spaced from said inner hot wall to define a convection cooling air flow passage therebetween.

13. A gas turbine engine combustor, comprising:

a combustion chamber defined at least in part by a combustor hot wall and having an upstream end and a downstream end;

at least one primary diverging mixing cone having a narrow inlet end, a wide outlet end, and a substantially conically shaped interior wall which diverges from said inlet end toward said outlet end, said at least one primary cone extending from said combustor hot wall into said combustion chamber for mixing unignited primary fuel and air within said cone and for depositing an unignited primary fuel and air mixture into said combustion chamber;

said at least one primary cone, by being disposed within said combustion chamber, creating a flow restriction in said combustion chamber to thereby separate the combustion chamber into primary and secondary combustion zones on opposite sides of said flow restriction, and said at least one primary cone being adapted to direct substantially all of said primary fuel and air mixture entering the inlet end of said at least one cone through the outlet end of said at least one primary cone and into said primary combustion zone, wherein said primary combustion zone is proximate said upstream end of said combustion chamber, and said at least one primary cone extends into said combustion chamber substantially tangentially relative to said combustor hot wall such that the primary fuel and air mixture exits the primary cone in a swirling direction around said primary combustion zone.

14. The combustor of claim 13, wherein said at least one primary cone is tilted toward said upstream end of said combustion chamber to direct the primary fuel and air mixture into said primary combustion zone.

15. The combustor of claim 13, including at least one secondary diverging mixing cone, having a narrow inlet end and a wide outlet end, disposed within said combustion chamber for mixing fuel and air and for depositing a secondary fuel and air mixture into said combustion chamber, said at least one secondary cone being adapted to direct said secondary fuel and air mixture into said secondary combustion zone.

16. The combustor of claim 15, wherein said combustion chamber is of a can-type configuration having a central axis, and said at least one secondary cone is aligned with said central axis such that said outlet end of said secondary cone terminate at said secondary combustion zone.

17. The combustor of claim 16, wherein said at least one primary cone is adapted to direct the primary fuel and air mixture in a circumferential, swirling flow about said primary combustion zone, and said at least one secondary cone is adapted to direct the secondary fuel and air mixture in a circumferential, swirling flow about said secondary combustion zone which is opposite in direction to the swirling flow in the primary combustion zone.

18. The combustor of claim 15, wherein said combustion chamber is of an annular configuration, and said at least one primary and secondary cones are each disposed within said combustion chamber to extend substantially tangentially relative to said hot combustor wall.

19. The combustor of claim 18, wherein said at least one primary cone is tilted toward said upstream end of said combustion chamber to direct said primary fuel and air mixture into said primary combustion zone, and said at least one secondary cone is titled toward said downstream end of said combustion chamber to direct the secondary fuel and air mixture into said secondary combustion zone.

20. The combustor of claim 19, wherein said at least one primary cone is disposed so as to direct the primary fuel and air mixture in a circumferential, swirling flow about the primary combustion zone, and said at least one secondary cone is disposed so as to direct the secondary fuel and air mixture in a circumferential, swirling flow about the secondary combustion zone which is opposite in direction to the swirling flow in the primary combustion zone.

21. A gas turbine engine combustor, comprising:

a combustion chamber having a central axis and being defined at least in part by a combustor hot wall, said chamber having an upstream end and a downstream end;

at least one primary diverging mixing cone and at least one secondary diverging mixing cone each having a narrow inlet end, a wide outlet end, and a substantially conically shaped wall which diverges from said inlet end toward said outlet end, said at least one primary cone and said at least one secondary mixing cone each extending from said combustor hot wall into said combustion chamber for mixing fuel and air within said cone and for depositing a fuel and air mixture into said combustion chamber;

said at least one primary cone by being disposed within said combustion chamber creating a flow restriction in said combustion chamber to thereby separate the combustion chamber into primary and secondary combustion zones on opposite sides of said flow restriction, said at least one primary cone being adapted to direct the fuel and air mixture emerging therefrom into said primary combustion zone in a first circumferential direction about the central axis of the combustion chamber, and said at least one secondary mixing cone being adapted to direct the fuel and air mixture emerging therefrom into said secondary combustion zone in a second circumferential direction, opposite the first circumferential direction, about the central axis of the combustion chamber.

* * * * *